US012480269B2

(12) United States Patent
Klein

(10) Patent No.: US 12,480,269 B2
(45) Date of Patent: Nov. 25, 2025

(54) TELESCOPIC JERSEY BARRIER

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 998 days.

(21) Appl. No.: 17/605,682

(22) PCT Filed: Apr. 30, 2020

(86) PCT No.: PCT/IB2020/054077
§ 371 (c)(1),
(2) Date: Oct. 22, 2021

(87) PCT Pub. No.: WO2020/222156
PCT Pub. Date: Nov. 5, 2020

(65) Prior Publication Data

US 2022/0205199 A1 Jun. 30, 2022

Related U.S. Application Data

(60) Provisional application No. 62/840,449, filed on Apr. 30, 2019.

(51) Int. Cl.
*E01F 15/08* (2006.01)
*E01F 13/04* (2006.01)
*E01F 15/12* (2006.01)

(52) U.S. Cl.
CPC ..... *E01F 15/088* (2013.01); *E01F 15/12* (2013.01); *E01F 13/048* (2013.01)

(58) Field of Classification Search
CPC ..... E01F 15/088; E01F 15/12; E01F 15/083; E01F 13/048
See application file for complete search history.

(56) References Cited

U.S. PATENT DOCUMENTS

| | | | | |
|---|---|---|---|---|
| 2,737,740 | A | 3/1956 | Genoe | |
| 2,783,055 | A | 2/1957 | Michaud | |
| 2,961,786 | A | 11/1960 | Lowmaster | |
| 3,982,734 | A * | 9/1976 | Walker | E01F 15/146 256/13.1 |
| 4,158,514 | A | 6/1979 | Dickinson | |
| 4,279,105 | A | 7/1981 | Cameron | |
| 4,354,771 | A | 10/1982 | Dickinson | |
| 4,367,975 | A | 1/1983 | Tyers | |
| 4,426,801 | A | 1/1984 | Gates | |
| 4,624,600 | A | 11/1986 | Wagner et al. | |
| 4,705,426 | A | 11/1987 | Perea | |
| 4,762,439 | A | 8/1988 | Carlyle | |
| 4,773,629 | A * | 9/1988 | Yodock | E01F 15/086 256/19 |

(Continued)

FOREIGN PATENT DOCUMENTS

| | | | |
|---|---|---|---|
| CN | 2853891 | Y | 1/2007 |
| CN | 204626286 | U | 9/2015 |

(Continued)

*Primary Examiner* — Abigail A Risic
(74) *Attorney, Agent, or Firm* — William H. Dippert; Laurence A. Greenberg; Werner H. Stemer

(57) ABSTRACT

The present subject matter provides a telescopic Jersey barrier, configured to easily and rapidly lengthen and shorten. The telescopic Jersey barrier includes multiple barrier units configured to be inserted one into the other. Additional embodiments of the telescopic Jersey barrier are described herein.

13 Claims, 3 Drawing Sheets

(56) References Cited

U.S. PATENT DOCUMENTS

| | | | | |
|---|---|---|---|---|
| 4,875,028 | A | 10/1989 | Chou | |
| 4,998,843 | A | 3/1991 | Mothe | |
| 5,188,342 | A | 2/1993 | Ouellette et al. | |
| 5,217,318 | A | 6/1993 | Peppel | |
| 5,535,555 | A | 7/1996 | Boyd et al. | |
| 5,588,774 | A | 12/1996 | Behan | |
| 5,798,102 | A | 8/1998 | McMichael et al. | |
| 5,882,140 | A * | 3/1999 | Yodock, Jr. | E01F 15/083 404/6 |
| 5,975,791 | A | 11/1999 | Mcculloch | |
| 6,409,418 | B1 | 6/2002 | Blair et al. | |
| 6,672,799 | B2 | 1/2004 | Earl | |
| 6,702,512 | B1 | 3/2004 | Reale | |
| 6,905,281 | B2 * | 6/2005 | Kang | E01F 15/146 404/9 |
| 7,025,526 | B2 | 4/2006 | Blair | |
| 7,172,176 | B1 | 2/2007 | Eastland | |
| 7,918,622 | B2 | 4/2011 | Whitford | |
| 7,950,173 | B2 | 5/2011 | Jedlicka | |
| 8,256,985 | B2 | 9/2012 | Ashmead | |
| 9,739,328 | B1 * | 8/2017 | Degroot | F16F 7/123 |
| 9,834,927 | B2 | 12/2017 | Huff | |
| 9,945,084 | B1 * | 4/2018 | Warford | E01F 15/146 |
| 10,266,999 | B2 | 4/2019 | Rothschild | |
| 10,724,191 | B2 | 7/2020 | Pan | |
| 2006/0076544 | A1 | 4/2006 | Kurple | |
| 2007/0264078 | A1 * | 11/2007 | Riotto | E06B 11/02 404/6 |
| 2009/0028639 | A1 | 1/2009 | Thomas | |
| 2010/0178104 | A1 | 7/2010 | Bare et al. | |
| 2012/0017743 | A1 | 1/2012 | Pierret et al. | |
| 2012/0121336 | A1 | 5/2012 | Arciszewski | |
| 2012/0177439 | A1 | 7/2012 | More et al. | |
| 2019/0161927 | A1 | 5/2019 | Pan | |

FOREIGN PATENT DOCUMENTS

| | | | |
|---|---|---|---|
| CN | 106049307 | A | 10/2016 |
| CN | 106468049 | A | 3/2017 |
| CN | 107227705 | A | 10/2017 |
| DE | 10108586 | A1 | 9/2002 |
| EP | 0253656 | A1 | 1/1988 |
| EP | 0465748 | A1 | 1/1992 |
| EP | 0823510 | A2 | 2/1998 |
| EP | 1293686 | A2 | 3/2003 |
| EP | 2107163 | A2 | 10/2009 |
| EP | 3323942 | A1 | 5/2018 |
| EP | 3447194 | | 2/2019 |
| FR | 2854413 | A1 | 11/2004 |
| GB | 1478840 | A | 7/1977 |
| GB | 2261006 | A | 5/1993 |
| GB | 2430964 | A | 4/2007 |
| GR | 20050100073 | A | 10/2006 |
| IL | 266217 | B1 | 6/2019 |
| IL | 284568 | A | 8/2021 |
| IL | 285873 | A | 10/2021 |
| IL | 287502 | A | 12/2021 |
| JP | 2000178932 | A | 6/2000 |
| JP | 4461330 | B2 | 5/2010 |
| JP | 2013221274 | A | 10/2013 |
| WO | 2007105940 | A1 | 9/2007 |
| WO | 2016030886 | A1 | 3/2016 |
| WO | 2019016812 | A1 | 1/2019 |
| WO | 2019097526 | A1 | 5/2019 |

* cited by examiner

TELESCOPIC JERSEY BARRIER

CROSS-REFERENCE TO RELATED PATENT APPLICATIONS

This patent application is a U.S. National Phase filing under 35 U.S.C. § 371 of PCT Patent Application No. PCT/IB2020/054077, filed Apr. 30, 2020, which is based upon and claims the priority to United States of U.S. Provisional Patent Application Ser. No. 62/840,449, filed Apr. 30, 2019, the entire contents each of which is incorporated herein by reference in its entirety.

FIELD

The present subject matter relates to Jersey barriers. More particularly, the present subject matter relates to telescopic Jersey barriers configured to be easily lengthen or shorten.

BACKGROUND

A Jersey barrier is a modular barrier used to separate lanes of traffic, reroute traffic, protect pedestrians and workers during highway construction and be used as temporary and semi-permanent protection against terror attacks like suicide vehicle bombs. Jersey barriers are made of concrete. However, plastic water-filled Jersey barrier are currently commonly used.

A prior art Jersey barrier comprises at least one barrier unit, or multiple barrier units that are positioned one adjacent to the other, or connected one to the other, in a line. When there is a need to lengthen a Jersey barrier, additional barrier units should be added to the line of barrier units, and when there is a need to shorten a Jersey barrier, barrier units should be removed from the line of barrier units. This renders the act of lengthening or shortening a Jersey barrier cumbersome and time consuming.

SUMMARY

Unless otherwise defined, all technical and scientific terms used herein have the same meaning as commonly understood by one of ordinary skill in the art to which this subject matter belongs. Although methods and materials similar or equivalent to those described herein can be used in the practice or testing of the present subject matter, suitable methods and materials are described below. In case of conflict, the patent specification, including definitions, will control. In addition, the materials, methods, and examples are illustrative only and not intended to be limiting.

According to one aspect of the present subject matter, there is provided a telescopic Jersey barrier, configured to easily and rapidly lengthen and shorten, comprising multiple barrier units configured to be inserted one into the other.

According to one embodiment, heights and widths of the barrier units are different one of the other, so that a barrier unit can be inserted into an adjacent barrier unit.

According to another embodiment, the heights and widths of the barrier units gradually decrease along a sequence of the barrier units, wherein the height and width of a first barrier unit in the sequence are larger than the heights and widths of other barrier units in the sequence, and the height and width of a last barrier unit in the sequence are smaller than the heights and widths of other barrier units in the sequence.

According to yet another embodiment, the barrier units are hollow.

According to still another embodiment, the barrier is further configured to be in a fully lengthened state, wherein all the barrier units are outside one from the other.

According to a further embodiment, when the barrier is in a fully lengthened state, a length of the barrier is equal to a sum of the lengths of all the barrier units of the barrier.

According to yet a further embodiment, the barrier is further configured to be in a partially shortened state, wherein at least some of the barrier units, or parts of the entire lengths of barrier units, are inserted into adjacent barrier units.

According to still a further embodiment, the barrier is further configured to be in a fully shortened state, wherein all the barrier units are inserted into a first barrier unit.

According to an additional embodiment, a length of the barrier in a fully shortened state is equal to a length of the first barrier unit.

According to yet an additional embodiment, when in a partially shortened state, the barrier has any length between the length in the fully shortened state, and the length in the fully lengthened length.

According to still an additional embodiment, the last barrier unit comprises at least one wheel configured to stand and roll on a ground where the barrier is positioned.

According to another embodiment, the at least one wheel is configured to facilitate movement of the last barrier unit during lengthening or shortening of the barrier.

According to yet another embodiment, the barrier further comprises an internal extendable element.

According to still another embodiment, the internal extendable element is configured to reside inside an internal space of the barrier units.

According to a further embodiment, the internal extendable element is configured to change its length.

According to yet a further embodiment, the internal extendable element has an accordion-like structure.

According to still a further embodiment, the internal extendable element is configured to fit its length to a length of the barrier.

According to an additional embodiment, the internal extendable element is configured to be in a fully lengthened state, and reside in the internal space of the barrier units of the barrier in the fully lengthened state.

According to yet an additional embodiment, the internal extendable element is configured to be in a fully shortened state, and reside in the internal space of the barrier units of the barrier in the fully shortened state.

According to still an additional embodiment, the internal extendable element is configured to be in a partially shortened state, and reside in the internal space of the barrier units of the barrier in the partially shortened state.

According to another embodiment, a first side of the internal extendable element is attached to the first barrier unit, and a second side of the internal extendable element is attached to the last barrier unit.

According to yet another embodiment, the first side of the internal extendable element is attached to the first barrier unit with a connector.

According to still another embodiment, a first side of the connector is pivotally connected to the first side of the internal extendable element, and a second side of the connector is pivotally connected to the first barrier unit.

According to a further embodiment, the connector is configured to extend and shorten.

According to yet a further embodiment, the connector is telescopic.

According to still a further embodiment, the at least one wheel is attached to the second side of the internal extendable element.

According to an additional embodiment, the first side of the internal extendable element is attached to the last barrier unit 1, and a second side of the internal extendable element is attached to the first barrier unit.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms may be embodied in practice.

In the drawings.

DESCRIPTION OF THE PREFERRED EMBODIMENTS

Figure 1:
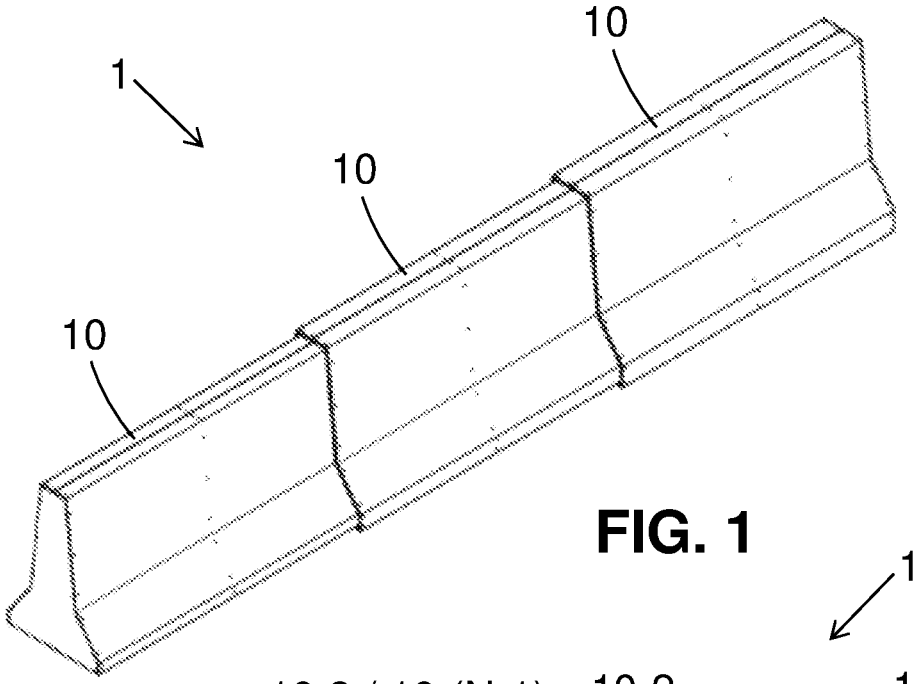
FIG. 1 schematically illustrates, according to an exemplary embodiment, a side perspective view of telescopic Jersey barrier in a fully lengthened state.

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale.

For clarity, non-essential elements were omitted from some of the drawings.

The present subject matter provides a telescopic Jersey barrier, configured to easily and rapidly lengthen or shorten. This embodiment makes the act of lengthening or shortening of a Jersey barrier easy and very short in time.

Figure 2:
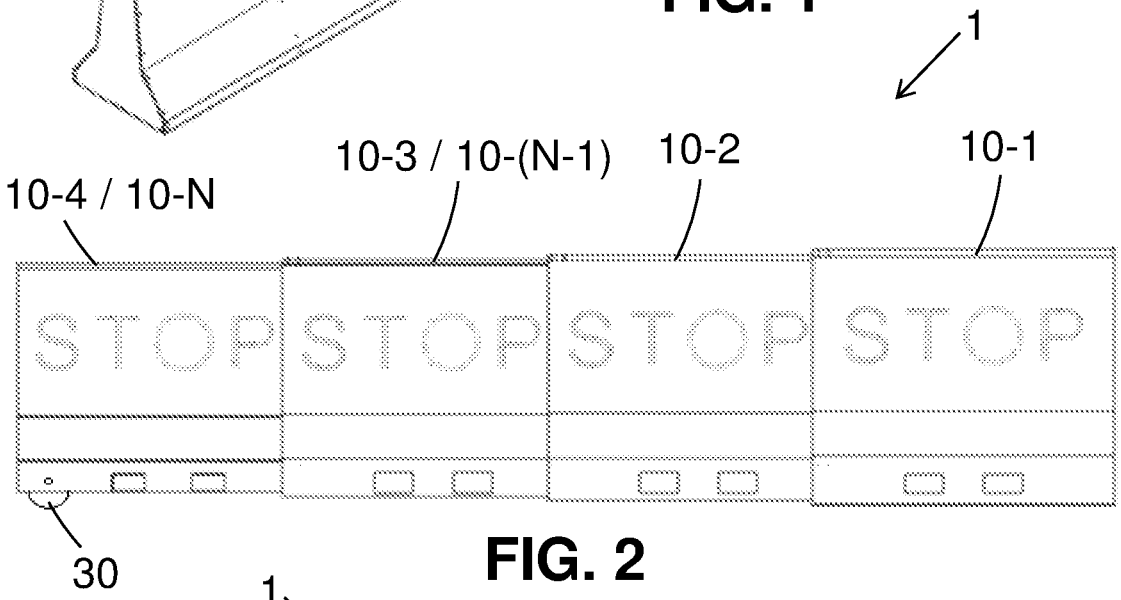
FIG. 2 schematically illustrates, according to an exemplary embodiment, a side view of a telescopic Jersey barrier in a fully lengthened state.
Figure 3:
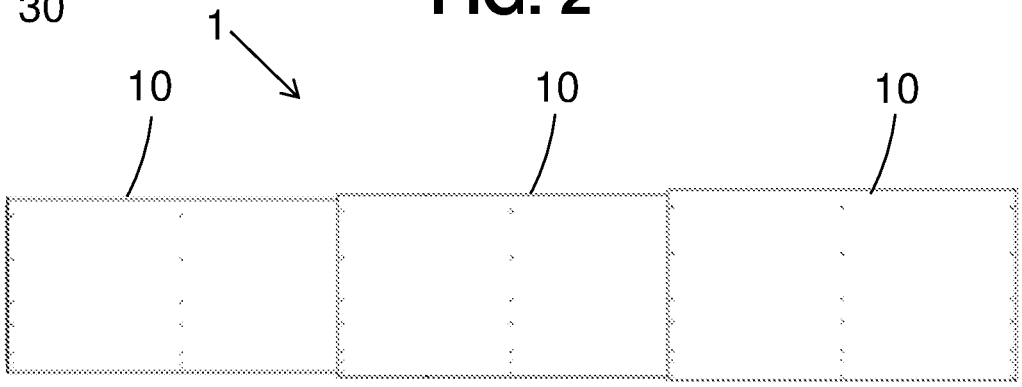
FIG. 3 schematically illustrates, according to an exemplary embodiment, a top view of a telescopic Jersey barrier in a fully lengthened state.

Referring now to FIGS. 1-3, schematically illustrating a side perspective view, a side view, and a top view, respectively, of telescopic Jersey barrier in a fully lengthened state.

According to one embodiment, the telescopic Jersey barrier 1 comprises multiple barrier units 10 configured to be inserted one into the other, as illustrated for example in FIGS. 1-3. According to one embodiment, the heights and widths of the barrier units 10 are different one of the other, so that a barrier unit 10 can be inserted into an adjacent barrier unit 10. It should be noted that when referring to a size of a barrier unit 10 it is meant to refer to the height and width of the barrier unit 10.

The number of barrier units 10 of the telescopic Jersey barrier is designed hereinafter as "N". As can be seen, for example in FIG. 2, the barrier units 10 can be aligned in sequence, and each barrier unit 10 can have a serial number—first barrier unit 10-1, second barrier unit 10-2 . . . before last barrier unit 10-(N−1) and last barrier unit 10-N. For example, the telescopic Jersey barrier 1 illustrated in FIG. 2 comprises four barrier units 10: a first barrier unit 10-1; a second barrier unit 10-2; a third barrier unit 10-3, that can also be referred to as a before last barrier unit 10-(N−1); and a fourth barrier unit 10-4, that can also be referred to as a last barrier unit 10-N.

According to one embodiment, the heights and widths of the barrier units 10 gradually decrease along a sequence of the barrier units 10, wherein the height and width of a first barrier unit 10-1 in the sequence are larger than the heights and widths of other barrier units 10 in the sequence, and the height and width of a last barrier unit 10-N in the sequence are smaller than the heights and widths of other barrier units 10 in the sequence.

In other words, the first barrier unit 10-1 is the biggest of the barrier units 10, in terms of height and width. The second barrier unit 10-2 is smaller than the first barrier unit 10-1 and is configured to be inserted into the first barrier unit 10-1, the third barrier unit 10-3, is smaller than the second barrier unit 10-2 and is configured to be inserted into the second barrier unit 10-2, and the fourth barrier unit 10-4, which is the last barrier unit 10-N, is smaller than the before last barrier unit 10-(N−1) (third barrier unit 10-3) and is configured to be inserted into the before last barrier unit 10-(N−1) (third barrier unit). Thus, in a telescopic Jersey barrier 1 comprising N barrier units, the first barrier unit 10-1 is the biggest of all the barrier units 10, and the last barrier unit 10-N is the smallest of all the barrier units 10, while the barrier units 10 in between, namely the second barrier unit 10-2 through the (N−1)th barrier unit 10-(N−1), are gradually smaller as their serial number increases. This enables insertion of the barrier units 10 one into the other as described above.

According to one embodiment, the barrier units 10 are hollow. This embodiment allows insertion of the barrier units 10 one into the other as described above.

According to one embodiment, the telescopic Jersey barrier 1 is configured to be in a fully lengthened state, as illustrated, for example in FIGS. 1-3. According to this embodiment, all the barrier units 10 are outside one from the other, and the telescopic Jersey barrier 1 is fully lengthened. In the fully lengthened state, the number of barrier units 10 determines the length of the telescopic Jersey barrier 1. As the number of the barrier units 10 increases, the length of the telescopic Jersey barrier 1 in the fully lengthened state increases as well. In the fully lengthened state, the length of the telescopic Jersey barrier 1 is equal to the sum of the lengths of all the barrier units 10.

Figure 4:
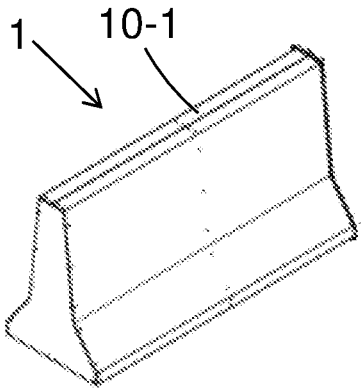
FIG. 4 schematically illustrates, according to an exemplary embodiment, a side perspective view of telescopic Jersey barrier in a fully shortened state.
Figure 5:
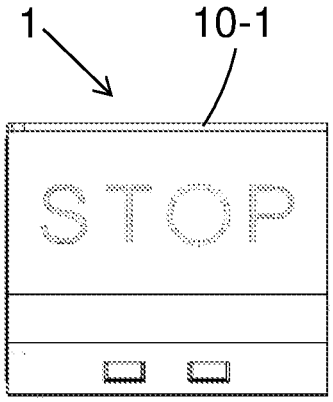
FIG. 5 schematically illustrates, according to an exemplary embodiment, a side view of telescopic Jersey barrier in a fully shortened state.
Figure 6:
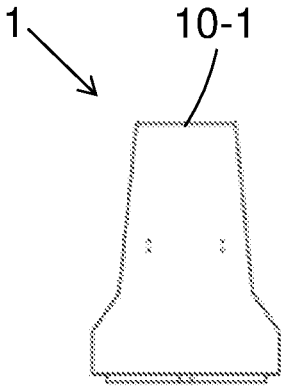
FIG. 6 schematically illustrates, according to an exemplary embodiment, a front view of a telescopic Jersey barrier.

Referring now to FIGS. 4-5, illustrating a side perspective view, and a side view, respectively, of a telescopic Jersey barrier in a fully shortened state; and to FIG. 6, schematically illustrating a front view of a telescopic Jersey barrier.

According to one embodiment, the telescopic Jersey barrier 1 is configured to be in a partially shortened state. In the partially shortened stand at least some of the barrier units 10, or parts of the entire lengths of barrier units 10, are inserted into adjacent barrier units 10. When all the barrier units 10 are inserted into adjacent barrier units 10, the telescopic Jersey barrier is in a fully shortened state, as illustrated, for example, in FIGS. 4-5. In the fully shortened state, all the barrier units 10 are inserted into the first barrier unit 10-1, which is the biggest barrier unit 10 of all the barrier units 10. Thus, the telescopic Jersey barrier 1 in the fully shortened state is in the mostly short length possible, while the mostly short length of the telescopic Jersey barrier 1 is determined by the length of the first barrier unit 10-1, which is the largest barrier unit 10. In other words, the length of the barrier 10 in the fully shortened state is equal to a length of the first barrier unit 10-1.

According to one embodiment, in the partially shortened state, the telescopic Jersey barrier 1 has any length between the length in the fully shortened state, illustrated for example in FIG. 5 and the length in the fully lengthened length, illustrated for example in FIG. 2.

Returning to FIG. 2, according to one embodiment, the last barrier unit 10-N comprises at least one wheel 30 configured to be positioned and roll on a ground where the telescopic Jersey barrier 1 is positioned. According to another embodiment, the last barrier unit 10-N comprises a wheel 30. According to yet another embodiment, the at least one wheel 30 is configured to facilitate movement of the last barrier unit 10-N during lengthening or shortening of the telescopic Jersey barrier 1 or any other unit of the barrier units.

Figure 7:
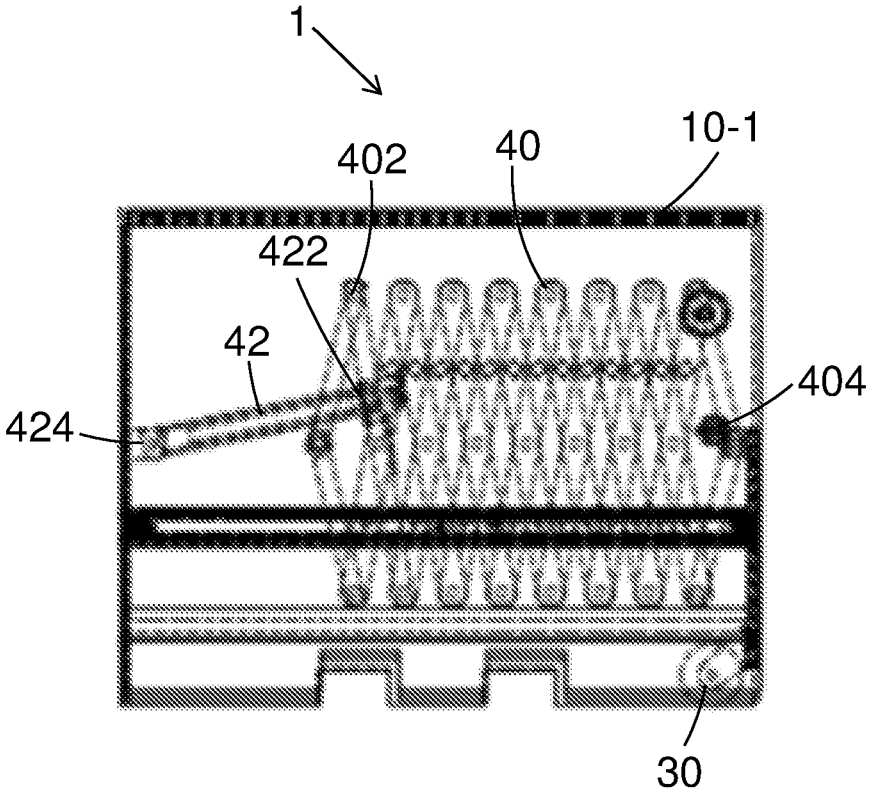
FIG. 7 schematically illustrates, according to an exemplary embodiment, a cut-of side view of a telescopic Jersey barrier in a fully shortened state, showing an internal content of the telescopic Jersey barrier.
Figure 8:
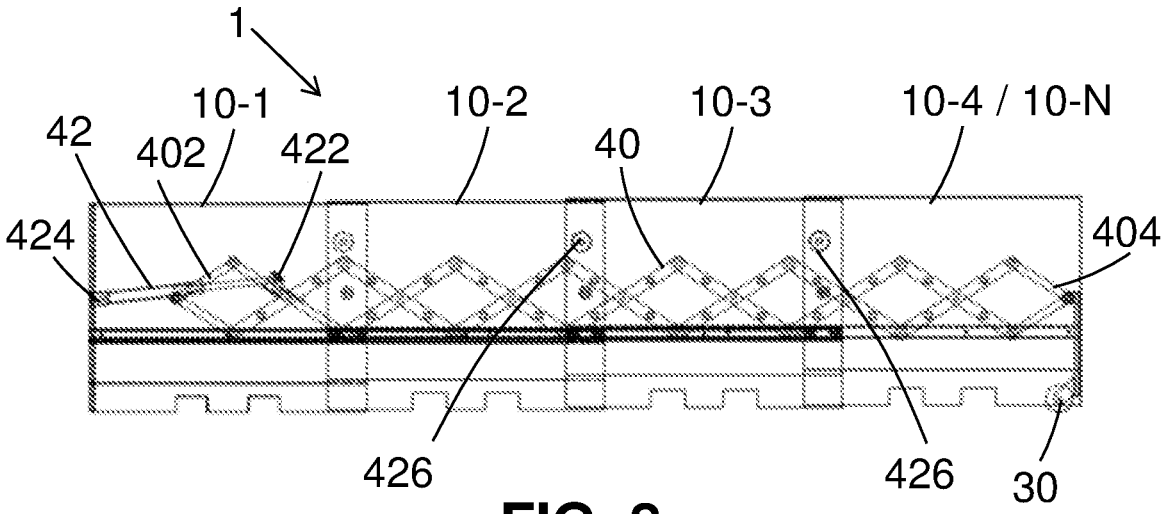
FIG. 8 schematically illustrates, according to an exemplary embodiment, a cut-of side view of a telescopic Jersey barrier in a fully lengthened state, showing an internal content of the telescopic Jersey barrier.

Referring now to FIGS. 7-8, schematically illustrating, a cut of-side view of a telescopic Jersey barrier in a fully shortened state and in a fully lengthened state, respectively, showing an internal content of the telescopic Jersey barrier.

According to one embodiment, the telescopic Jersey barrier 1 further comprises an internal extendable element 40. FIGS. 7 and 8 illustrate the internal extendable element 40 placed inside the internal space of the barrier units 10 in a contracted state and extendable state, respectively. The internal extendable mechanism can be an X shaped accordion mechanism (or scissors extension mechanism) as will be illustrated and explained herein after.

FIG. 8 illustrates the barrier units in lengthened state wherein the barrier units are provided with a flexible connection 426 that prevents the barrier units from being fully separated one from the other. Other mechanisms can prevent the full separation of the barrier units such as bent opposite edge that doesn't allow the interior unit being separated from the unit that accommodates it.

Figure 9:
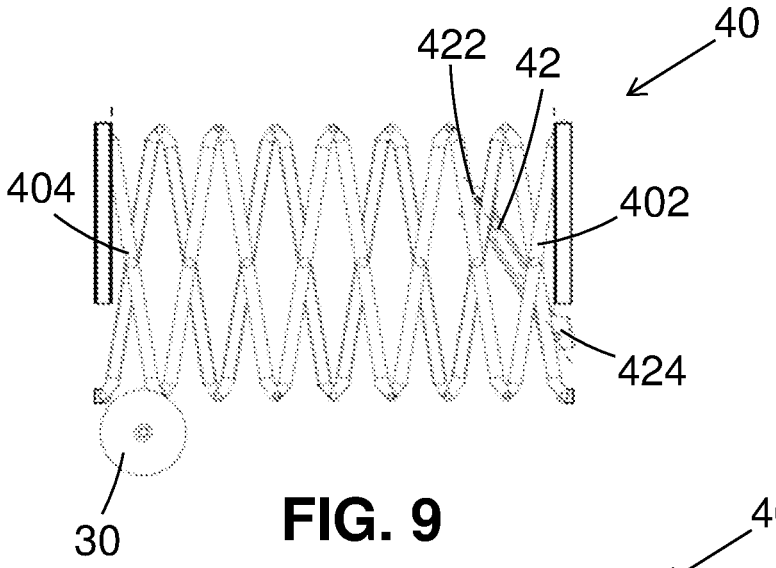
FIG. 9 schematically illustrates, according to an exemplary embodiment, a side view of an extendable element in a contracted state.
Figure 10:
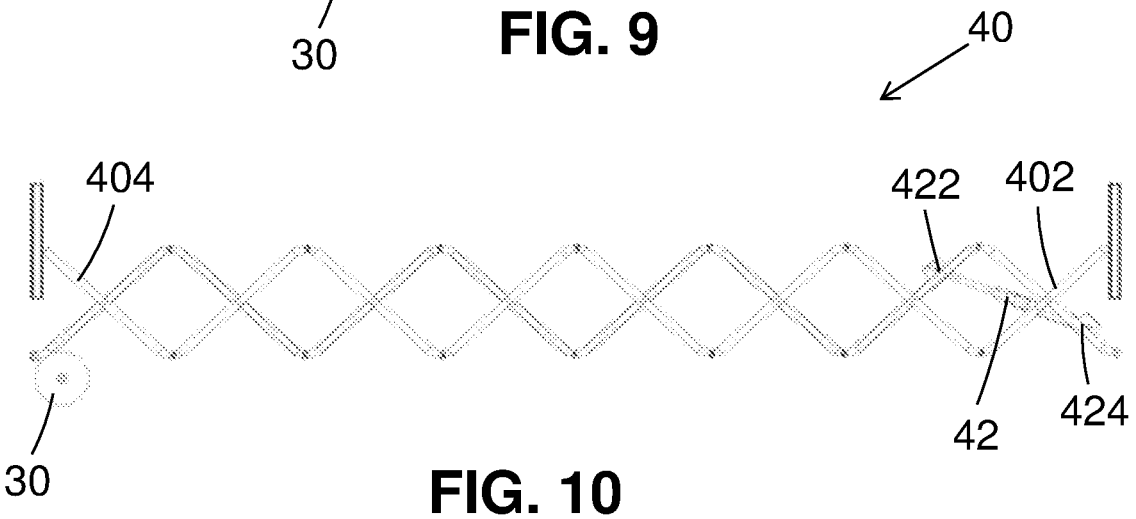
FIG. 10 schematically illustrates, according to an exemplary embodiment, a side view of an extendable element in an extended state.

Referring now to FIGS. 9-10, schematically illustrating a side view of an extendable element in a contracted state, and in an extended state, respectively. FIGS. 9 and 10 illustrate the internal extendable element 40 per se.

According to one embodiment, the internal extendable element 40 is configured to reside inside an internal space of the barrier units 10. According to another embodiment, the internal extendable element 40 is configured to change its length. According to yet another embodiment, the internal extendable element 40 has an accordion-like structure. As known in the art, an accordion-like structure is extendable. According to still another embodiment, the internal extendable element 40 is configured to fit its length to the length of the telescopic Jersey barrier 1.

According to one embodiment, the internal extendable element 40 is configured to be in a fully extendable state in which the barrier is in its maximal length, as illustrated in FIGS. 8 and 10. In the fully extendable state, the internal extendable element 40 is fully extendable and resides in the internal space of the barrier units 10 of the telescopic Jersey barrier 1 in the fully lengthened state, as illustrated in FIG. 8.

According to one embodiment, the internal extendable element 40 is configured to be in a fully shortened state, as illustrated in FIGS. 7 and 9. In the fully shortened state, the internal extendable element 40 is fully contracted and resides in the internal space of the barrier units 10 of the telescopic Jersey barrier 1 when in the fully shortened state, as illustrated in FIG. 7.

According to one embodiment, the internal extendable element 40 is configured to be in a partially contracted state. In the partially shortened state, the internal extendable element 40 is partially shortened and resides in the internal space of the barrier units 10 of the telescopic Jersey barrier 1 in the partially shortened state.

According to one embodiment, illustrated for example in FIGS. 9 and 10, the internal extendable element 40 comprises a first side 402 and a second side 404.

According to one embodiment, the first side 402 of the internal extendable element 40 is attached to the first barrier unit 10-1, and the second side 404 of the internal extendable element 40 is attached to the last barrier unit 10-N. Any attachment mechanism known in the art, for attaching the first side 402 of the internal extendable element 40 to the first barrier unit 10-1, and for attaching the second side 404 of the internal extendable element 40 to the last barrier unit 10-N, is under the scope of the present subject matter, for example adhering, welding, screwing and the like. According to another embodiment, the first side 402 of the internal extendable element 40 is attached to the first barrier unit 10-1 with a connector 42, as can be seen for example in FIGS. 7 and 8. According to yet another embodiment, the connector 42 comprises a connector first side 422 and a connector second side 424. According to still another embodiment, the connector first side 422 is pivotally connected to the first side 402 of the internal extendable element 40, and the connector second side 424 is pivotally connected to the first barrier unit 10-1. The importance of this embodiment relies in that during extension of the internal extendable element 40, the angle between the connector 40 and the internal extendable element 40 as well as the first barrier unit 10-1 to which it is attached may change. Thus, if the connection would have been stiff, the connector 40 could resist the extension of the internal extendable element 40. Therefore, a pivotal connection as described above overcomes this issue.

According to one embodiment, the connector 42 is configured to extend and shorten. According to another embodiment, the connector 42 is telescopic. This embodiment confers flexibility to the connector 42 and the internal extendable element 40, for example in the distance between a wall of the first barrier unit 10-1 and the first side 402 of the internal extendable element 40 to which the connector 42 is attached. As can be seen in FIG. 7, the telescopic connector 42 is shortened, and as can be seen in FIG. 8, the telescopic connector 42 is extended.

According to one embodiment, the at least one wheel 30 described above is attached to the second side 404 of the internal extendable element 40.

It should be noted that the orientation of the internal extendable element 40 relative to the barrier units 10 of the telescopic Jersey barrier 1 can be as described above. However, according to another embodiment, the orientation of the internal extendable element 40 relative to the barrier units 10 of the telescopic Jersey barrier 1 can be opposite. Briefly, in other words, the first side 402 of the internal extendable element 40 is attached to the last barrier unit 10-N according to the aforementioned embodiments, and the second side 404 of the internal extendable element 40 is attached to the first barrier unit 10-1.

It should be noted that any other extendable mechanism such as, but not limited to, a flexible cable, a V shaped accordion-like extension mechanism, telescopic mechanism, a combination or a like. Moreover, although there is a teaching of internal extension structures for extending the length of the Jersey barrier, the extension mechanism can also be external to the structure, without limiting the scope of the present invention.

It is appreciated that certain features of the subject matter, which are, for clarity, described in the context of separate embodiments, may also be provided in combination in a single embodiment. Conversely, various features of the subject matter, which are, for brevity, described in the context of a single embodiment, may also be provided separately or in any suitable sub combination.

Although the subject matter has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A telescopic Jersey barrier configured to easily and rapidly lengthen and shorten, the telescopic Jersey barrier comprising multiple hollow barrier units having a first barrier unit and a last barrier unit, wherein the multiple hollow barrier units are configured to be inserted one into the other and an internal extendable element having a first side and a second side wherein the internal extendable element is configured to reside inside an internal space of the barrier units in all states from a fully shortened state to a fully lengthened state and vice versa, wherein the first side is attached to the first barrier unit and the second side is attached to the last barrier unit, and wherein the first side is attached to the first barrier unit with a connector that is configured to extend and shorten.

2. The telescopic Jersey barrier of claim 1, wherein heights and widths of the barrier units are different from one another, so that a barrier unit can be inserted into an adjacent barrier unit.

3. The telescopic Jersey barrier of claim 2, wherein the heights and widths of the barrier units gradually decrease along a sequence of the barrier units, wherein the height and width of a first barrier unit in the sequence are larger than the heights and widths of other barrier units in the sequence, and the height and width of a last barrier unit in the sequence are smaller than the heights and widths of other barrier units in the sequence.

4. The telescopic Jersey barrier of claim 1, wherein in the fully lengthened state, all the barrier units are outside one from the other.

5. The telescopic Jersey barrier of claim 4, wherein when in the fully lengthened state, a length of the barrier is substantially equal to a sum of the lengths of all the barrier units of the telescopic Jersey barrier.

6. The telescopic Jersey barrier of claim 1, wherein in the partially shortened state, at least some of the barrier units, or parts of the entire lengths of barrier units, are inserted into adjacent barrier units.

7. The telescopic Jersey barrier of claim 1, wherein in the fully shortened state, all the barrier units are inserted into a first barrier unit.

8. The telescopic Jersey barrier of claim 1, wherein a last barrier unit of the barrier units comprises at least one wheel configured to be positioned and roll on a ground where the barrier is positioned.

9. The telescopic Jersey barrier of claim 8, wherein the at least one wheel is configured to facilitate movement of the last barrier unit during lengthening or shortening of the barrier.

10. The telescopic Jersey barrier of claim 1, wherein the internal extendable element is configured to change its length according to a length of the telescopic Jersey barrier.

11. The telescopic Jersey barrier of claim 10, wherein the internal extendable element has an accordion-like structure.

12. The telescopic Jersey barrier of claim 11, wherein the internal extendable element is configured to fit its length to a length of the telescopic Jersey barrier.

13. The telescopic Jersey barrier of claim 1, wherein the barrier units are provided with a flexible connection that prevents the barrier units from being fully separated one from the other.

* * * * *